US008973651B2

(12) United States Patent
Fuhst et al.

(10) Patent No.: US 8,973,651 B2
(45) Date of Patent: Mar. 10, 2015

(54) MODULAR ANCHORING SUB FOR USE WITH A CUTTING TOOL

(75) Inventors: Karsten Fuhst, Hannover (DE); Sven Krueger, Niedersachsen Winsen (DE); William J. Befeld, Richmond, TX (US)

(73) Assignee: Baker Hughes Incorporated, Houston, TX (US)

( * ) Notice: Subject to any disclaimer, the term of this patent is extended or adjusted under 35 U.S.C. 154(b) by 492 days.

(21) Appl. No.: 13/161,667

(22) Filed: Jun. 16, 2011

(65) Prior Publication Data

US 2012/0318509 A1 Dec. 20, 2012

(51) Int. Cl.
*E21B 29/00* (2006.01)
*E21B 23/01* (2006.01)

(52) U.S. Cl.
CPC ..... *E21B 29/005* (2013.01); *E21B 23/01* (2013.01)
USPC ..... 166/55.6; 166/298

(58) Field of Classification Search
USPC ..... 166/297, 298, 64, 280, 55–55.8
See application file for complete search history.

(56) References Cited

U.S. PATENT DOCUMENTS

| | | | | |
|---|---|---|---|---|
| 3,661,205 | A * | 5/1972 | Belorgey | 166/66.4 |
| 4,809,793 | A * | 3/1989 | Hailey | 175/265 |
| 5,097,905 | A | 3/1992 | Goodwin | |
| 5,649,595 | A | 7/1997 | Davis et al. | |
| 5,697,445 | A | 12/1997 | Graham | |
| 5,794,703 | A | 8/1998 | Newman et al. | |
| 6,176,313 | B1 * | 1/2001 | Coenen et al. | 166/280.1 |
| 6,702,031 | B2 * | 3/2004 | Doane et al. | 166/382 |
| 6,868,901 | B2 | 3/2005 | Mason et al. | |
| 7,185,715 | B2 | 3/2007 | Krueger | |
| 7,228,912 | B2 | 6/2007 | Patel et al. | |
| 7,383,876 | B2 * | 6/2008 | Gray et al. | 166/55.7 |
| 7,770,667 | B2 | 8/2010 | Moore | |
| 8,113,271 | B2 * | 2/2012 | Fuhst et al. | 166/55.7 |
| 8,261,828 | B2 * | 9/2012 | Fuhst et al. | 166/298 |
| 2002/0162659 | A1 | 11/2002 | Davis et al. | |
| 2007/0012449 | A1 * | 1/2007 | Cruickshank et al. | 166/298 |
| 2009/0078402 | A1 * | 3/2009 | Fuhst et al. | 166/55.7 |
| 2009/0301723 | A1 * | 12/2009 | Gray | 166/301 |
| 2010/0258289 | A1 | 10/2010 | Lynde et al. | |

FOREIGN PATENT DOCUMENTS

| | | | |
|---|---|---|---|
| WO | 9807955 | A2 | 2/1998 |
| WO | 2010065994 | A1 | 6/2010 |

OTHER PUBLICATIONS

International Search Report and Written Opinion Issued Nov. 5, 2012 in PCT/US2012/034365 (8 pages).

* cited by examiner

*Primary Examiner* — David Andrews
*Assistant Examiner* — Ronald Runyan
(74) *Attorney, Agent, or Firm* — Bracewell & Giuliani LLP

(57) ABSTRACT

A cutting tool that inserts into a tubular for cutting the tubular from within. The cutting tool includes a motor, a cutting head, permanent anchor between the motor and cutting head, an electronics portion, and a modular anchoring sub that can be between the motor and electronics portion or on the upper end of the cutting tool. The modular anchoring sub provides flexibility in where anchoring elements are positioned so that depending on the application, the modular anchoring sub can be positioned so that it provides its maximum anchoring force for stabilizing the cutting tool during use.

13 Claims, 3 Drawing Sheets

32
30
34
10A
26
12A
28
24
θ
Ax
Y
10
22
18
14
12
16
20
19

MODULAR ANCHORING SUB FOR USE WITH A CUTTING TOOL

BACKGROUND

1. Field of Invention

The invention relates generally to operations in a wellbore. More specifically, the present invention relates to an apparatus and method for maintaining stability while severing a tubular.

2. Description of Prior Art

Tubular members, such as those disposed within a hydrocarbon producing wellbore, can be severed from the inside by inserting a cutting device within the hollow space. From time to time, portions of tubulars may become unusable and require replacement; while some tubulars or their segments have a pre-determined lifetime and are scheduled for replacement. Moreover, some wellbore tubulars have sections that are removed during completion of the wellbore. When a tubular is to be severed, either for repair, replacement, demolishment, or some other reason, a cutting tool is typically inserted within the tubular, positioned for cutting at the desired location, and activated to cut the tubular. The cutting tools are generally outfitted with a blade or other cutting member for severing the tubular.

SUMMARY OF THE INVENTION

The present disclosure provides a method and apparatus for severing a tubular. An example embodiment of a cutting tool for severing a tubular includes a motor section with an enclosed motor and a cutting head driven by the motor. An anchor section is between the motor section and cutting head, where anchoring members in the anchor section selectively engage an inner surface of the tubular to anchor the cutting tool. Also included is a modular anchoring sub mounted on an end of the motor section distal from the anchor section. Elements on the modular anchoring sub engage the tubular. Ends of the modular anchoring sub having modular connectors. This allows selective placement of the modular anchoring sub to be between the motor section and an additional section or on an end of the additional section opposite from the motor section. Optionally, the additional section is a controller sub. The modular connectors, in one example, provide connectivity to a control line used for controlling the cutting tool. A spacer sub can be disposed between the motor section and the modular anchoring sub. Elements of the modular anchoring sub can be axially spaced apart and independently moveable. An umbilical may be disposed axially through the modular anchoring sub and having opposing ends that connect to modular connectors on opposing ends of the modular anchoring sub. The modular anchoring sub can optionally be on the end of the additional section distal from the motor section, and the modular connector on the end of the modular anchoring sub distal from the additional section can couple to a control line for controlling the cutting tool.

Also disclosed herein is an example embodiment of a method of severing a tubular that involves providing a cutting tool that includes a motor section having a motor, and a cutting blade. An anchor section is included that is between the motor section and cutting head and has anchoring members. The cutting tool also has a controller section and a modular anchoring sub with anchoring elements. The method further includes coupling the modular anchoring sub and the controller section on an end of the motor section distal from the anchor section in a sequence or order based on an expected use of the cutting tool. The cutting tool is inserted into the tubular and the cutting blade is rotated by the motor to sever the tubular. Optionally, the cutting tool can be anchored by extending the anchoring members and the anchoring elements. The order of how the modular anchoring sub and the controller section are coupled positions the modular anchoring sub such that an anchoring force is exerted on the cutting tool by the anchoring members and anchoring elements that is greater than an anchoring force exerted on the cutting tool by the anchoring members and anchoring elements in any other possible sequence. In an example, the modular anchoring sub has opposing ends each fitted with a modular coupling and an umbilical connected between the modular couplings. Thus when the modular anchoring sub couples on one end to the controller section, and on an opposite end to the motor section, the modular couplings on the modular anchoring sub engage modular couplings on the controller section and the motor section to provide communication between the controller section and motor section through the umbilical. In an example, the expected use of the cutting tool is within a non-linear portion of the tubular. Alternatively, the cutting tool is disposed in a horizontal wellbore and wherein the anchoring members and the anchoring elements support and centralize the cutting tool within the tubular. The modular anchoring sub can include a first modular anchoring sub between the motor section and the controller section, where the method further includes coupling a second modular anchoring on an end of the controller section distal from the first modular anchoring sub.

Also included is an alternate method of wellbore operations at a wellbore site that in one example includes providing a cutting tool to the site. In this example the cutting tool is made up of a motor section having a motor, a cutting blade, and an anchor section with anchoring members. The anchor section is between the motor section and cutting head. Also included with the cutting tool is a modular anchoring sub with anchoring elements and a controller section coupled to an end of the motor section distal from the anchor section. An anchoring force exerted onto the cutting tool by the modular anchoring sub is estimated for the modular anchoring sub being positioned between the motor section and controller section and positioned on an end of the controller section distal from the motor section. While at the site the modular anchoring sub is coupled with the controller section and in the position where the modular anchoring sub provides maximum anchoring force. The tubular is severed by inserting the cutting tool into the tubular and rotatingly engaging the tubular with the cutting blade. Alternatively, communication is provided through the modular anchoring sub between the motor section and a conveyance means for deploying and controlling the cutting tool.

BRIEF DESCRIPTION OF DRAWINGS

Some of the features and benefits of the present invention having been stated, others will become apparent as the description proceeds when taken in conjunction with the accompanying drawings, in which.

Figures 1, 2, 3:
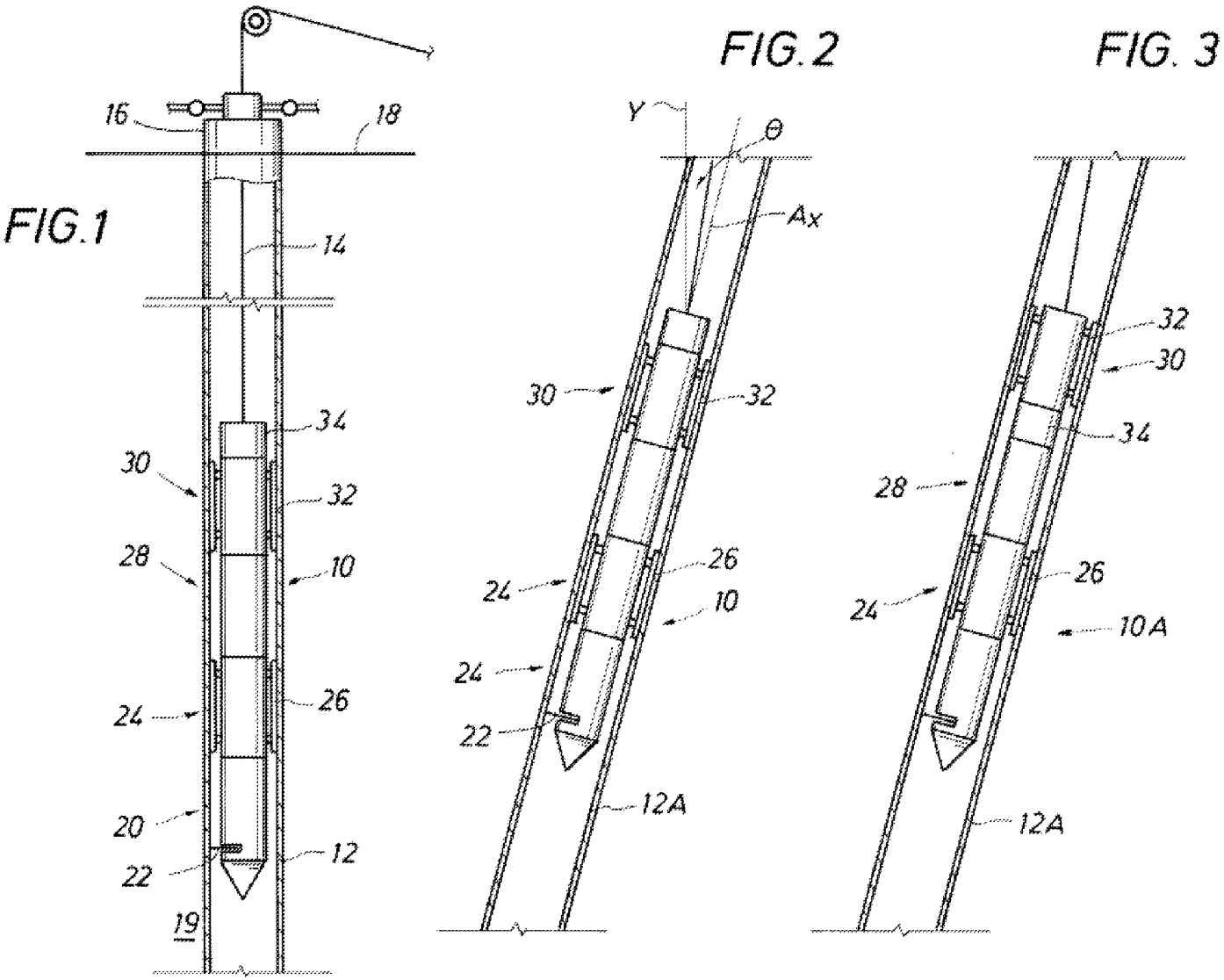
FIG. 1 is a side partial sectional view of an example embodiment of a cutting tool in accordance with the present invention.
FIG. 2 is a side partial sectional view of the cutting tool of FIG. 1 in a deviated portion of a wellbore.
FIG. 3 is a side partial sectional view of an alternate embodiment of a cutting tool in a deviated portion of a wellbore in accordance with the present invention.

While the invention will be described in connection with the preferred embodiments, it will be understood that it is not intended to limit the invention to those embodiments. On the contrary, it is intended to cover all alternatives, modifications, and equivalents, as may be included within the spirit and scope of the invention.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

Cutting tools for severing tubulars typically include an anchor or other stabilizing device for bracing against the tubular to counter the reactive forces generated by cutting. Often, cutting tools for wellbore tubulars are relatively elongated so the components making up the cutting tool can be packaged in a single unit for insertion into the usually narrow wellbore tubular. The elongate configuration can be difficult to stabilize when subjected to the reactive forces of cutting.

Referring now to FIG. 1, one example of a cutting assembly 10 is shown inserted within a tubular 12 and deployed on a conveyance means 14. Examples of the conveyance means 14 include wireline, slick line, coil tubing, and the like. The conveyance means 14 depends within the tubular 12 from a wellhead assembly 16 on surface 18. The tubular 12 is shown inserted within a wellbore 19; examples of a tubular 12 include production tubing, casing, a downhole tool, and any annular member in a wellbore. In the example embodiment of FIG. 1, the cutting assembly 10 is an elongate member having a cutting head 20 disposed on a lower end. The cutting head 20 which is rotatable, includes a selectively extendable and retractable cutting blade 22 that projects radially outward from a lateral side of the cutting head 20. The cutting assembly 10 further includes an anchoring section 24 shown coupled on an upper end of the cutting head 20 and including anchoring legs 26 shown extending radially from the anchoring section 24 and into engagement with an inner surface of the tubular 12. An example of a device for anchoring a cutting tool in a tubular is found in U.S. Pat. No. 7,575,056, which is owned by the assignee of the present application and incorporated by reference herein in its entirety. Motor section 28 is also included with the cutting assembly 10 and has a motor (not shown) for driving the cutting head 20 and cutting blade 22. A shaft (not shown) extends from the motor and downward to the cutting head 20 for rotating the cutting head 20.

A modular anchoring sub 30 is shown releaseably coupled on an upper end of the motor section 28. The anchoring sub 30 includes anchoring elements 32 that, similar to the anchoring legs 26, selectively project radially outward and into anchoring engagement with an inner surface of the tubular 12. On an upper end of the modular anchoring sub 30 is a controller section 34. The upper end of the controller section 34 is shown connecting to the conveyance means 14. As will be discussed in further detail below, signaling and control means are provided within the conveyance means 14 that are directed to other devices within the cutting assembly 10. The signaling and control means includes hardware, such as controllers, processors, and other information handling systems for monitoring and controlling operation of the cutting assembly 10 Providing the modular anchoring sub 30 within the cutting assembly 10 and at a position distal from the permanently included anchoring section 24 enhances the stability of the cutting assembly 10 when set within the tubular 12. This is especially so when the reactive cutting forces generated by cutting the tubular 12 with the cutting blade 22 are exerted onto the cutting assembly 10.

FIG. 2 depicts the cutting assembly 10 set within a deviated tubular 12A and at an angle θ with respect to an axis Y vertical to gravity; thereby also angling an axis $A_x$ of the cutting assembly 10 with respect to axis Y. Distally placing the modular anchoring sub 30 stabilizes the cutting assembly 10 within the tubular 12A so that as the cutting head 20 rotates thereby cutting along the circumference of the tubular 12A, a substantially constant anchoring force may be obtained tor preventing vibration and other movement of the cutting assembly 10.

An optional embodiment of the cutting assembly 10A is shown in a side view in FIG. 3. In this example embodiment, the cutting assembly 10A is set within a deviated tubular 12A and at an angle with vertical. In this example, the modular anchoring sub 30 is shown set on an end of the controller section 34 distal from the motor section 28. As such, the distance from the permanent anchoring section 24 to the anchoring elements 32 of the modular anchoring sub is increased over the embodiment of FIGS. 1 and 2, thereby further enhancing the stabilizing effect realized by use of the modular anchoring sub 30. Couplings on the opposing ends of the modular anchoring sub 30 provide for quick and releasable engagement with couplings on the ends of the controller section 34 and on the end of the motor section 28. The modular couplings allow for selective repositioning of the modular anchoring sub 30 along the cutting assembly 10.

As a further illustration of the stability of use of the modular anchoring sub 30 with the cutting assembly 10, the cutting assembly 10 is shown in a horizontal tubular 12B. In this example, the respective anchoring legs 26 and anchoring elements 32 of the anchoring section 24 and modular anchoring sub 30 may be coordinated to centralize the cutting assembly 10 within the tubular 12B, while at the same time of stabilizing the cutting assembly 10. The effect of centralizing and stabilizing the cutting assembly 10 provides an even cut as the cutting blade 22 is used to sever a section of the tubular 12B.

Figure 5:
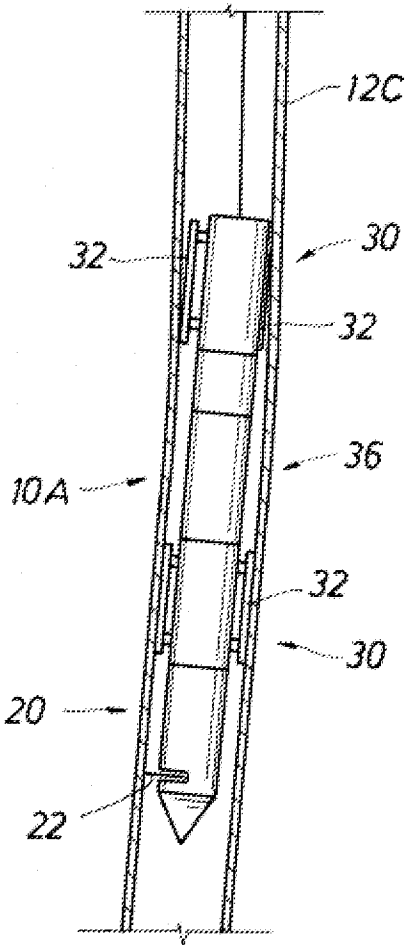
FIG. 5 is a side partial sectional view of the cutting tool of FIG. 3 in a portion of a wellbore having a bend.
Figure 4:
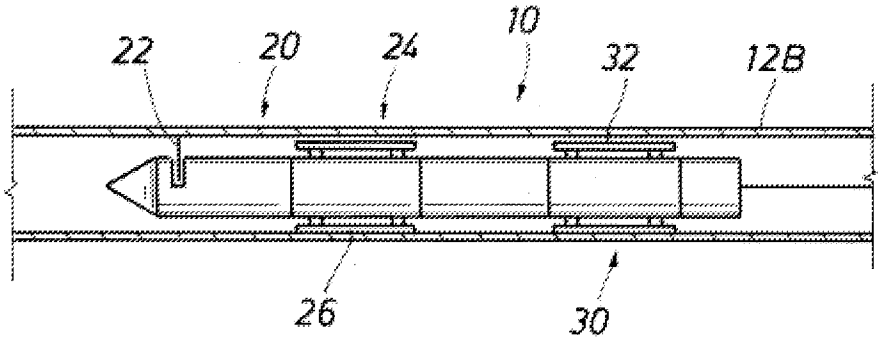
FIG. 4 is a side partial sectional view of the cutting tool of FIG. 1 in a horizontal portion of a wellbore.

A further advantage of the modular anchoring sub 30 is shown in a side view in FIG. 5. In this example, the cutting assembly 10A is set within a substantially vertically disposed tubular 12C having a bend 36 coinciding along the length of the cutting assembly 10A. In this example, the anchoring elements 32 on one side of the modular anchoring sub 30 are substantially retracted. While on an opposing side of the bend 36 the anchoring elements 32 are substantially extended so that the portion of the cutting assembly 10 extending past the bend 36 may be substantially centered within the tubular 12C. Centering the blade portion of the cutting assembly 10 allows for a more stable and generally cleaner cutting action than if the cutting head 20 were asymmetrically disposed within the tubular 12C.

Another alternate embodiment of the cutting assembly 10B is shown in the tubular 12C wherein separate and distinct anchoring elements 32B are disposed on the modular anchoring sub 30B and that are axially spaced apart. As such, the radial distance each individual anchoring element 32B projects from the modular anchoring sub 30B may vary depending on its respective axial and/or angular location on the modular anchoring sub 30B. This provides yet additional flexibility of accurately and concisely disposing the cutting assembly 10 for concentrically placing the cutting head 20 within the portion of the tubular 12C to be severed.

Figure 7:
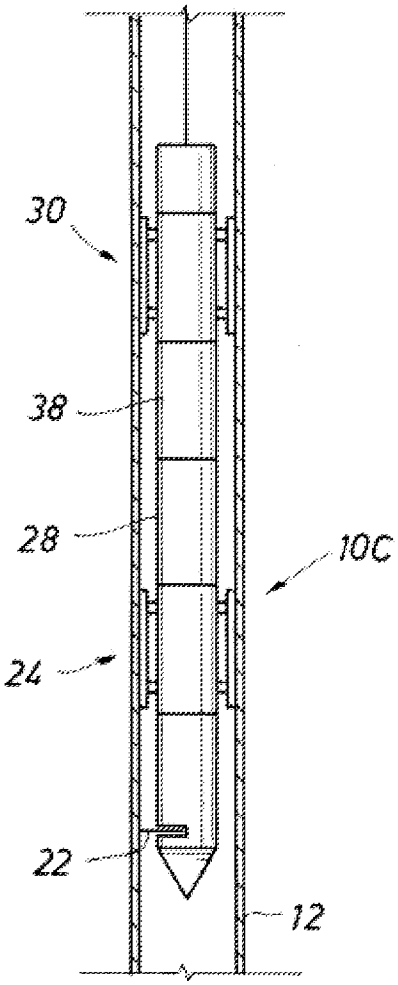
FIG. 7 is a side partial sectional view of an alternate embodiment of a cutting tool in accordance with the present invention.
Figure 6:
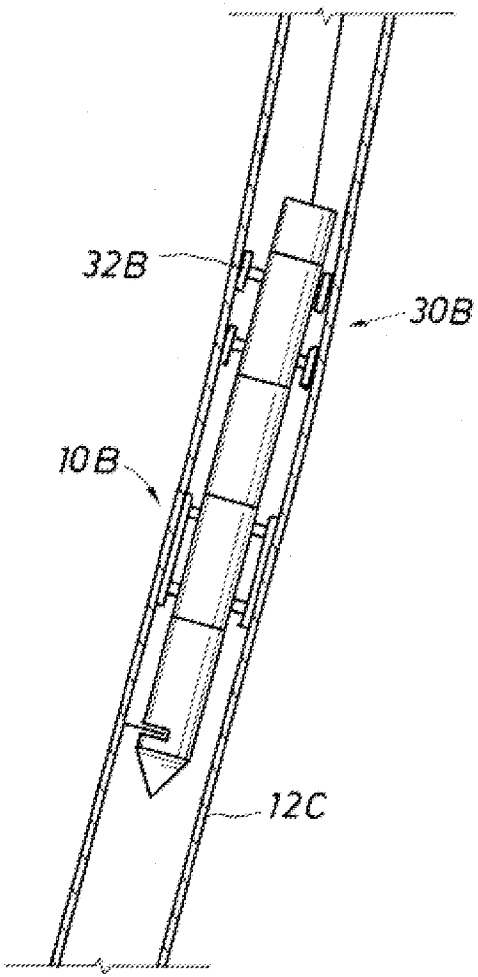
FIG. 6 is a side partial sectional view of an alternate embodiment of a cutting tool in a portion of a wellbore having a bend in accordance with the present invention.

In yet another optional embodiment, a spacer sub 38 is provided with an embodiment of the cutting assembly 10C. In the example of FIG. 7, the spacer sub 38 is disposed between the motor sub 28 and modular anchoring sub 30. This provides more flexibility for setting the axial distance between the permanent anchoring section 24 and modular anchoring sub 30.

Figure 8:
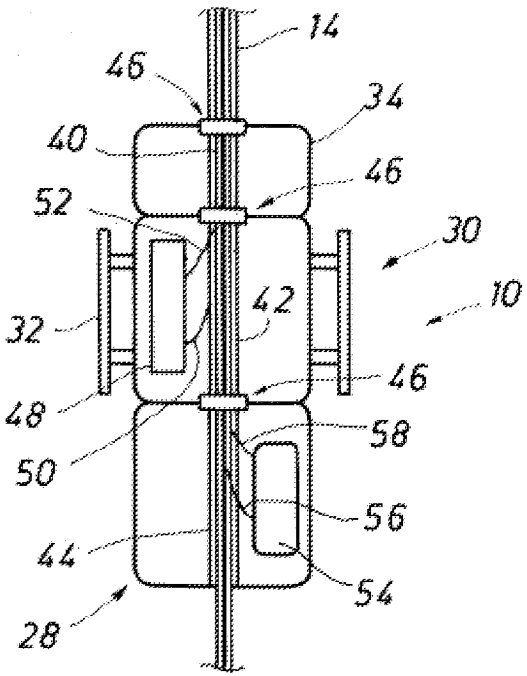
FIG. 8 is a side sectional view of a portion of the cutting tool of FIG. 1.

Referring now to FIG. 8, shown in a side sectional view is a portion of the cutting assembly 10 of FIG. 1. In the example of FIG. 8, umbilicals 40, 42, 44 extend vertically through each of the controller section 34 modular anchoring sub 30 and motor section 28. The upper end of the uppermost umbilical 40 couples with the conveyance means 14. The umbilicals 40, 42, 44 include control lines for sending control signals to components within the cutting assembly 10 as well as power such as electrical or hydraulic for powering actuatable devices within the cutting assembly 10. Modular connectors 46 are shown on the upper and lower ends of both the controller section 34 and modular anchoring sub 30. The connectors 46 enable selectively positioning the controller section 34 and modular anchoring sub 30 in the various sequences as illustrated in FIGS. 1 and 3. As far as the mechanical couplings between these sections, they may be threaded or bolt on type flanges. In one example embodiment, the mechanical connectors are configured so that connections between these sections may be performed on the site where the tubular is located.

One example of a component controlled and powered by lines through the umbilicals 40, 42, 44 is an actuator 48 schematically illustrated within the modular anchoring sub 30. More specifically, a power line 50 is shown connecting the actuator 48 with the umbilical 42 and a control line 52 extends between the actuator 48 and umbilical 42. In the example embodiment of FIG. 8, the actuator 48 is used for selectively extending and retracting the anchoring elements 32 provided with the modular anchoring sub. Similarly, a motor 54 set within the motor section 28 receives power through a power line 56 connecting the motor 54 with umbilical 44 and may receive control signals via a control line 58 extending from the umbilical 44 to the motor 54.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A cutting tool for severing a tubular comprising:

motor section having a motor;

a cutting head driven by the motor;

an anchor section having members that selectively extend to and retract from engagement with the tubular;

a modular anchoring sub selectively coupled to an end of the motor section distal from the anchor section and having elements that selectively extend to and retract from engagement with the tubular; and modular connectors on opposing ends of the modular anchoring sub, so that when a controller sub is coupled to the cutting tool on a side of the motor distal from the anchor section, the modular anchoring sub is selectively interchangeable in a position between the motor section and the controller sub and a position on an end of the controller sub distal from the motor section.

2. The cutting tool of claim 1, wherein the modular connectors provide connectivity to a control line used for controlling the cutting tool.

3. the cutting tool of claim 1, further comprising a spacer sub disposed between the motor section and t he modular anchoring sub.

4. The cutting tool of claim 1, wherein the elements of the modular anchoring sub are axially spaced apart and independently moveable.

5. The cutting tool of claim 1, further comprising and umbilical disposed axially through the modular anchoring sub, wherein the umbilical comprises lines for conveying at least one of a control signal and power, and wherein the lines have opposing ends that connect to modular connectors on opposing ends of the modular anchoring sub, and that selectively disconnect so that the modular anchoring sub can connect to and umbilical in an additional section and on a side of the additional section distal from the motor, or connect to the umbilical in the additional section on a side of the additional section proximal the motor section.

6. The cutting too of claim 5, wherein when the modular anchoring sub is on the end of the additional section distal from the motor section, the modular connector on the end of the modular anchoring sub distal from the additional section couples to the control line for controlling the cutting tool.

7. The cutting tool of claim 1, wherein the anchoring section is disposed between the motor section and cutting head.

8. A method of severing a tubular comprising:

providing a cutting tool comprising a motor section having a motor, a cutting head having a cutting blade; and anchor section affixed between the motor section and cutting head and having anchoring members; a modular anchoring sub having anchoring elements; and a controller section;

coupling the modular anchoring sub with an end of the controller section distal from the motor section and so that the modular anchoring sub defines a terminal end of the cutting tool that is distal from cutting blade;

decoupling the modular anchoring sub from the controller section, switching positions of the modular anchoring sub and the controller section, so that the modular anchoring sub is between the controller section and the motor section; and disposing the cutting tool into the tubular and driving the cutting blade with the motor to sever the tubular, and wherein the modular anchoring sub and controller section each have an umbilical extending axially therethrough that comprises a line for conveying a signal, a line for conveying power, and connectors on opposing ends o the lines, and wherein the step of coupling the modular anchoring sub on a terminal end of the cutting tool includes engaging connectors in the modular anchoring sub with connectors in the controller section.

9. The method of claim 8, further comprising increasing the distance between the modular anchoring sub and the anchoring members by adding a spacer sub in the cutting tool between the modular anchoring sub and the motor section.

10. The method of claim 8, wherein the cutting tool is disposed in a horizontal wellbore and wherein the anchoring members and the anchoring elements support and centralize the cutting tool within the tubular.

11. The method of claim 8, wherein the modular anchoring sub comprises a first modular anchoring sub and is between the motor section and the controller section, the method further comprising coupling a second modular anchoring on an end of the controller section distal from the first modular anchoring sub.

12. A method of severing a tubular at a wellbore site comprising:

providing a cutting tool to the site that comprises a motor section having a motor, a cutting head having a cutting blade; an anchor section affixed between the motor section and cutting head and having anchoring members; a modular anchoring sub having anchoring elements, and a controller section coupled to an end of the motor section distal from the anchor section;

estimating an anchoring force exerted onto the cutting tool by the modular anchoring sub for positions comprising between the motor section and controller section and on an end of the controller section distal from the motor section;

increasing a distance between the anchor section and the modular anchoring sub by adding a spacer sub between the modular anchoring sub and the anchor section;

inserting the cutting, tool into a location in the tubular so that a bend in the tubular is between the modular anchoring sub and the cutting blade;

centralizing an end of the cutting tool having the cutting blade in the tubular and asymmetrically positioning the modular anchoring sub in the tubular; and severing the tubular by rotatingly engaging the tubular with the cutting blade.

13. The method of claim 12, further comprising providing communication through the modular anchoring sub between the motor section and a conveyance means for deploying and controlling the cutting tool.

* * * * *